US005170764A

United States Patent [19]

Tuckey

[11] Patent Number: 5,170,764

[45] Date of Patent: Dec. 15, 1992

[54] FUEL PUMP PICK-UP SYSTEM

[75] Inventor: Charles H. Tuckey, Cass City, Mich.

[73] Assignee: Walbro Corporation, Cass City, Mich.

[21] Appl. No.: 813,126

[22] Filed: Dec. 23, 1991

[51] Int. Cl.[5] ..... F02M 39/00

[52] U.S. Cl. ..... 123/509; 123/514; 137/571

[58] Field of Search ..... 123/510, 511, 514, 516, 123/509; 137/571, 574, 576

[56] References Cited

U.S. PATENT DOCUMENTS

| | | | |
|---|---|---|---|
| 4,672,937 | 6/1987 | Fales | 123/509 |
| 4,834,132 | 5/1989 | Sasak | 123/514 |
| 4,844,704 | 7/1989 | Jiro | 123/509 |
| 4,860,714 | 8/1989 | Bucci | 123/509 |
| 4,869,225 | 9/1989 | Nagata | 123/509 |
| 4,971,017 | 11/1990 | Beakley | 123/509 |
| 4,974,570 | 12/1990 | Szwargulski | 123/509 |
| 5,018,502 | 5/1991 | Humpl | 123/509 |
| 5,040,516 | 8/1991 | Haraguchi | 123/509 |
| 5,046,471 | 9/1991 | Schmid | 123/509 |

*Primary Examiner*—Carl S. Miller

*Attorney, Agent, or Firm*—Barnes, Kisselle, Raisch, Choate, Whittemore & Hulbert

[57] ABSTRACT

A multiple pick-up for a fuel pump in a fuel tank which includes an in-tank pump with a combined filter and diaphragm to control flow of fuel to the pump inlet. A first pump base supports the pump and contains the diaphragm and valve for a primary fuel supply. A second valve base with a similar diaphragm controlled valve is located in the fuel tank at a position remote from the first base. A fuel connection between the bases provides a supply of fuel to the pump at the first base in the event the diaphragm, actuated by lack of fuel at the first base, closes a fuel inlet valve in the first base. Lack of fuel at the second base will also close the fuel inlet valve at the remote second base, and the lack of fuel supply will cause an engine to stop.

3 Claims, 2 Drawing Sheets

FUEL PUMP PICK-UP SYSTEM

FIELD OF INVENTION

Fuel pumps for internal combustion engines including in-tank reservoirs and electric motors with filtered inlets.

BACKGROUND AND FEATURES OF THE INVENTION

In some vehicles powered by internal combustion engines, electric pumps mounted on the fuel tank itself are used to provide fuel to the engines. The fuel inlet for the pumps is generally directly below the pump and includes a fuel U.S. Pat. No. 4,747,388 issued May 31, 1988 discloses an in-tank fuel reservoir in which a pump is mounted within the reservoir. When ample fuel is present in the fuel tank, it flows through a filter directly to the pump. However, the filter is formed as a diaphragm and should there be low fuel at the bottom of the reservoir, the filter acts as a diaphragm to open a valve which admits reserve fuel on the reservoir to the pump inlet. In periods of low fuel, the wet diaphragm will not pass air and the pressure drop above the filter causes it to be drawn upwardly to actuate the valve to release fuel from the reservoir.

In most instances, this system is satisfactory since the pump is located in a symmetrical tank and will be responsive to low fuel level. However, in some vehicles the tanks are not symmetrical due to space problems in the vehicle construction. For example, in some snowmobile vehicles, the tank is elongate and has a high area where the pump is vertically positioned with the inlet near the bottom of the tank but the tank top tapers off to a low area quite remote from the pump inlet. When fuel is low and the vehicle is angled on a hill or for other reasons, the fuel is moved away from the main pump inlet and the engine will become starved of fuel. This can cause serious damage to the engine since, especially in two cycle engines, an extremely lean fuel source will cause the engine pistons to heat up and seize.

The present invention is directed to a multiple fuel pick-up where a main inlet below the pump is provided with an actuating diaphragm and valve which will close the main pump inlet when fuel is not present at the main inlet. A remote inlet spaced from the main inlet is then subjected to reduced pressure form the pump and fuel from the remote pick-up is drawn to the pump from another area of the tank where fuel is found. In the event the fuel is depleted from both areas of the tank, both valves at the multiple locations will close and the engine will instantly stall, thus preventing engine damage.

It is then an object of the invention to provide multiple and remote fuel inlets which will feed the fuel pump selectively under low fuel conditions and also shut off the pump inlets entirely when fuel is exhausted, thus shutting down the engine.

Other objects and features of the invention will be apparent in the following description and claims in which details of the invention are set forth to enable those skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
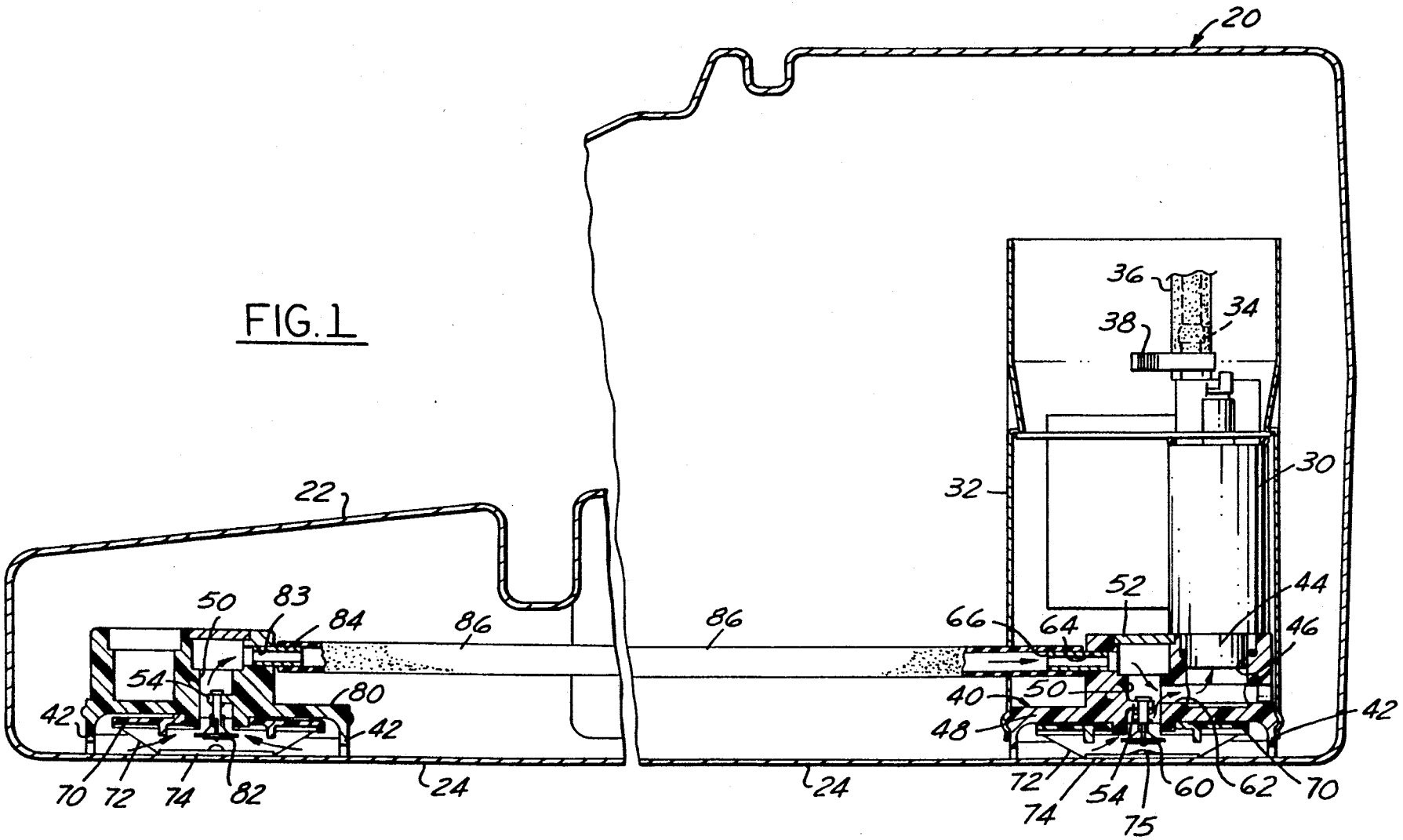
FIG. 1, a sectional view of a fuel tank with an in-tank incorporated at one location and a second inlet at a remote location.
Figure 2:
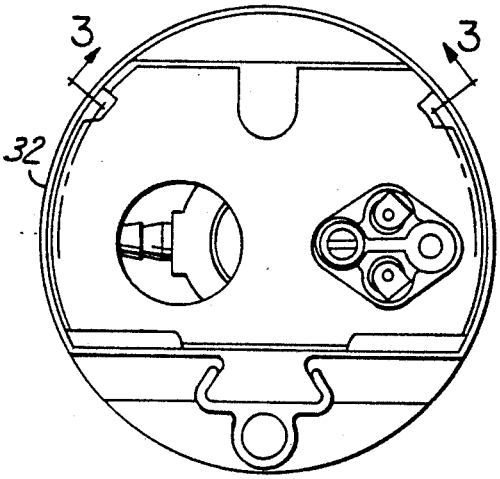
FIG. 2, a top view of an in-tank assembly.
Figure 3:
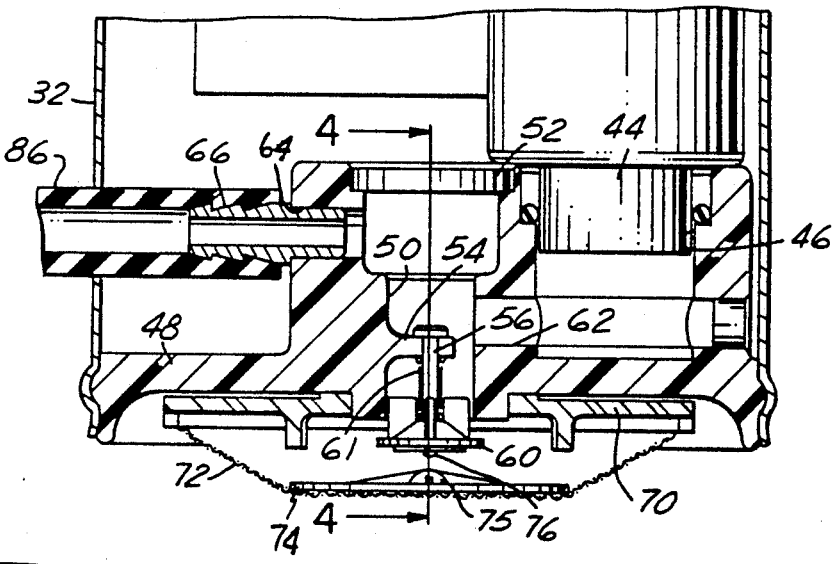
FIG. 3, a sectional view on line 3—3 of FIG. 2.
Figure 4:
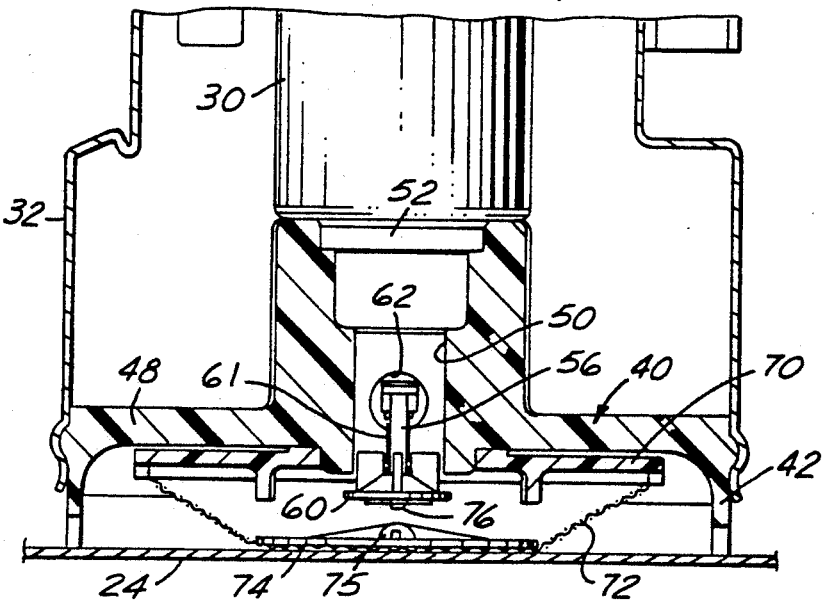
FIG. 4, a sectional view on line 4—4 of FIG. 3.

With reference to FIG. 1, a fuel tank as used, for example, in a snowmobile, has a high portion 20 and tapers off to a low portion 22 remote from the high portion, both portions having a common bottom 24. A pump 30 is supported in a surrounding housing 32 as shown in the referenced U.S. Pat. No. 4,747,388. A pump outlet nipple 34 is connected to an outlet hose 36 clamped at 38. The housing 32 is supported on the bottom 24 of the tank by a machined base 40 which is spaced from the tank bottom by projections 42. An ensmalled inlet portion 44 of the pump is received in a top recess 46 in the base (FIG. 4). The base 40 has a wall 48 extending across the bottom of the housing 32, this wall having a central valve chamber opening 50 capped by a cup-plug 52. A side support projection 54 (FIG. 3) supports a sliding stem 56 of a valve 60 which cooperates with a valve seat at the lower end of opening 50 and is spring biased to an open position by spring 61.

A cross-passage 62 connects valve chamber 50 with the pump inlet 44. A second cross-passage 64 above the passage 62 leads to an auxiliary connection 66 and opens to the opening 50 as will be described below. Mounted on a short projection at the bottom of base 40 is a plate 70 which supports a filter diaphragm 72 having a central plate 74 with a central contact domed portion 75. The valve 60 has a small central projection 76 to cooperate with the domed portion 75.

Looking to the left side of FIG. 1 in the shallow portion of the tank 22 is a second machined base 80 with parts similar to base 40 at the right bearing the same reference characters. The valve chamber 50 has a cross-passage 83 with a connector 84. A tube 86 connects connector 84 with connector 66 on base 40. A valve 82 in base 80 is similar to valve 60 in base 40.

The filter diaphragm 72 can be made of fine flexible wire mesh material but is preferably formed of a plastic mesh of woven strands or a similar material with woven strands with small openings which, when wet, will resist the flow of air because of capillary action. In the absence of fuel, air in the main tank will try to pass through the filter material. The wet filter will reject the passage of air due to the liquid capillary seal of the filter material. The pressure drop above the filter created by the pump will then cause the filter to act as a diaphragm to move it upwardly. This motion will cause the domed center 75 to act on the valve 60 to close the valve seat leading to passage 62 and the pump inlet 44.

Closing of valve 60 creates a reduced pressure in passage 64 and tube 86 leading to auxiliary base 80 and assuming fuel in the vicinity of base 80, it will be pulled into the pump inlet through passage 83, tube 86, connector 66, opening 50, and passage 62. Thus, the canting of the vehicle to move fuel into the shallow but remote end of the tank 22 will allow fuel to reach the pump inlet 44. Should fuel become exhausted in tank portion 22 below base 80, the diaphragm 72 will then rise to close valve 82 at this base and the engine will shut off due to lack of fuel at both the base 40 and 80.

Thus, a knowledgeable operator, realizing his fuel is getting low can tilt the vehicle to the low side of the tank and possibly avoid a shut-off until reaching a supply area.

What is claimed is:

1. A fuel supply for an internal combustion engine comprising:

(a) an elongate fuel tank, (b) an in-tank fuel pump at one portion of said tank having a bottom inlet, (c) a first body adjacent the bottom of the tank having a closable shut-off valve to control fuel flow from the tank to the fuel pump inlet, (d) a first combination of a first filter serving also as a first diaphragm to control said valve to close the valve in the first body in the absence of liquid fuel at said first diaphragm, (e) a second body adjacent the bottom of the tank remote from but in communication with said first body having also a closable shut-off valve to control fuel flow from said tank to said first body, and (f) a second combination of a second filter serving also as a second diaphragm to control the shut-off valve in said second body to allow flow to said first body in the presence of liquid fuel and to close said valve in the absence of fuel adjacent said second body.

2. A fuel supply as defined in claim 1 in which said fuel pump is supported in said tank on said first body and said fuel inlet is connected to a fuel chamber in said first body, and said second remote body has a fuel outlet in communication with said first body and with the pump inlet.

3. A fuel supply as defined in claim 2 in which said bodies are connected by a continuous conduit extending from the fuel chamber of said first body to the fuel outlet of said remote second body.

* * * * *